US008708189B2

(12) United States Patent
Reitzig

(10) Patent No.: US 8,708,189 B2
(45) Date of Patent: Apr. 29, 2014

(54) DISPOSABLE PEST ENTRY COVER FOR OPEN BOTTLES

(71) Applicant: William G. Reitzig, Miller Place, NY (US)

(72) Inventor: William G. Reitzig, Miller Place, NY (US)

( * ) Notice: Subject to any disclaimer, the term of this patent is extended or adjusted under 35 U.S.C. 154(b) by 0 days.

(21) Appl. No.: 13/712,097

(22) Filed: Dec. 12, 2012

(65) Prior Publication Data

US 2013/0153590 A1 Jun. 20, 2013

Related U.S. Application Data

(60) Provisional application No. 61/610,701, filed on Mar. 14, 2012, provisional application No. 61/610,272, filed on Mar. 13, 2012, provisional application No. 61/576,570, filed on Dec. 16, 2011.

(51) Int. Cl.

| | |
|---|---|
| ***B65D 25/34*** | (2006.01) |
| ***B65D 43/03*** | (2006.01) |
| *B65D 51/12* | (2006.01) |

(52) U.S. Cl.

USPC ..... 220/730; 220/380; 220/256.1; 220/287

(58) Field of Classification Search

USPC ..... 220/730, 256.1, 287, 376, 380, 62, 220/62.1; D9/445, 444; 229/122.1

See application file for complete search history.

(56) References Cited

U.S. PATENT DOCUMENTS

| | | | | |
|---|---|---|---|---|
| 2,844,245 | A * | 7/1958 | Gruber et al. | 206/216 |
| 4,027,778 | A | 6/1977 | Tupper | |
| 4,305,771 | A * | 12/1981 | McLaren | 156/227 |
| 4,693,410 | A | 9/1987 | Selz | |
| 4,867,325 | A | 9/1989 | Dransfield | |
| 4,872,577 | A | 10/1989 | Smith | |
| 5,102,002 | A | 4/1992 | Whitley | |
| 5,452,818 | A * | 9/1995 | Yost | 220/258.2 |
| 6,227,144 | B1 | 5/2001 | Quintero | |
| 6,276,551 | B1 * | 8/2001 | Miller, II | 220/287 |
| 6,511,726 | B1 | 1/2003 | Kinigakis | |
| 6,659,833 | B1 * | 12/2003 | Sloot | 446/71 |
| 8,100,287 | B2 * | 1/2012 | Milnark | 220/709 |
| 2006/0016820 | A1 * | 1/2006 | Himes et al. | 220/740 |
| 2007/0044435 | A1 | 3/2007 | Sotile | |
| 2007/0138187 | A1 | 6/2007 | Glass | |
| 2008/0190945 | A1 * | 8/2008 | Milnark | 220/709 |

(Continued)

OTHER PUBLICATIONS

Notification of Transmittal of the International Search Report, the International Search Report and the Written Opinion of the International Searching Authority (in English), each dated May 20, 2013, issued from Applicant's corresponding PCT Application No. PCT/US12/69155, filed on Dec. 12, 2012, from the International Searching Authority at the U.S. Patent and Trademark Office.

*Primary Examiner* — Mickey Yu

*Assistant Examiner* — Niki Eloshway

(74) *Attorney, Agent, or Firm* — Gerald T. Bodner

(57) ABSTRACT

A disposable pest entry barrier and open bottle cover is constructed in various shapes, such as conical or cylindrical, having a sidewall, a closed end and an opposite open end. The bottle cover is formed from a disposable material, such as cardboard or plastic. The bottle cover is coated or sprayed with a solution consisting primarily of lemongrass essential oil. This oil solution acts as a natural repellent and deters fruit flies and other contaminating pests from entering the open end of a bottle on which the bottle cover is placed.

15 Claims, 3 Drawing Sheets

(56) References Cited

U.S. PATENT DOCUMENTS

2009/0152272 A1* 6/2009 Guptil ..... 220/361
2010/0196520 A1 8/2010 Elraz
2010/0288785 A1* 11/2010 Duron ..... 220/780
2011/0220650 A1* 9/2011 Edmunds ..... 220/367.1
2013/0043245 A1* 2/2013 Griffis ..... 220/200

* cited by examiner

DISPOSABLE PEST ENTRY COVER FOR OPEN BOTTLES

CROSS-REFERENCE TO RELATED APPLICATIONS

This application is related to U.S. Provisional Application Ser. No. 61/576,570, filed on Dec. 16, 2011, and entitled "Disposable Pest Entry Cover for Open Bottles", U.S. Provisional Application Ser. No. 61/610,272, filed on Mar. 13, 2012, and entitled "Disposable Pest Entry Cover for Open Bottles", and U.S. Provisional Application Ser. No. 61/610,701, filed on Mar. 14, 2012, and also entitled "Disposable Pest Entry Cover for Open Bottles", the disclosure of each of which is incorporated herein by reference and on which priority is hereby claimed.

BACKGROUND OF THE INVENTION

1. Field of the Invention

The present invention relates to bottle covers, and more particularly relates to covers that are placed on the top of open-pour liquor and wine bottles located in bars and restaurants.

2. Description of the Prior Art

Disposable covers and caps have been used in bars and restaurants to cover the open ends of open-pour liquor and wine bottles. Such covers and caps are designed to address local health department and, possibly, FDA, concerns regarding sanitary conditions at local eating and drinking establishments. One such cap used for this purpose, which is also used as an ice cream cone holder, is disclosed in U.S. Patent Application Publication No. 2007/0044435 (Sotile), filed on Aug. 24, 2005. Although the cap disclosed in the aforementioned Sotile published patent application claims to prevent pest entry into the bottle on which it is mounted, the cap provides no deterrent to the pests from landing or crawling on the caps. As a result, the chance that such pests will find a path to enter the bottle will most likely increase.

OBJECTS AND SUMMARY OF THE INVENTION

It is an object of the present invention to provide a disposable pest entry barrier and cover for use with open bottles, which includes a safe, natural repellent for pests that deters fruit flies and other contaminating pests from entering a bottle on which the cover is mounted.

It is a further object of the present invention to provide a disposable pest entry barrier and cover for use with open bottles which overcomes the inherent disadvantages of conventional pest entry caps such as those disclosed in the aforementioned Sotile published patent application.

In accordance with one form of the present invention, the disposable pest entry barrier and open bottle cover is constructed in various shapes, such as conical or cylindrical, having a sidewall, a closed end and an opposite open end. The bottle cover of the present invention is preferably formed from a disposable material, such as cardboard or plastic. What further differentiates the bottle cover of the present invention from conventional bottle covers is that the bottle cover is coated or sprayed with a solution consisting primarily of lemongrass essential oil. This oil solution acts as a natural repellent and deters fruit flies and other contaminating pests from entering the open end of a bottle on which the bottle cover is placed.

The sidewall of the bottle cover of the present invention also provides a space to place a logo or other advertisement thereon, offering corporations an opportunity to promote their brand through distinctive advertising.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 3:
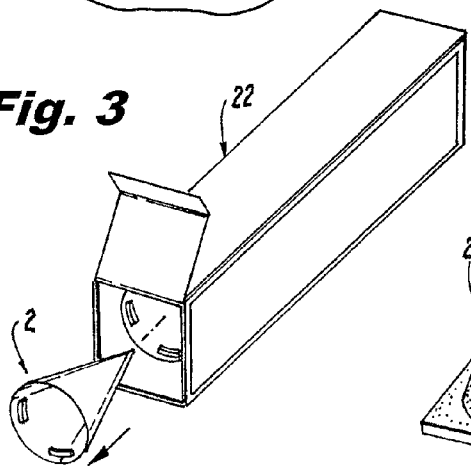
FIG. 3 is a perspective view of a package of stackable and disposable bottle covers formed in accordance with the present invention.
Figure 4:
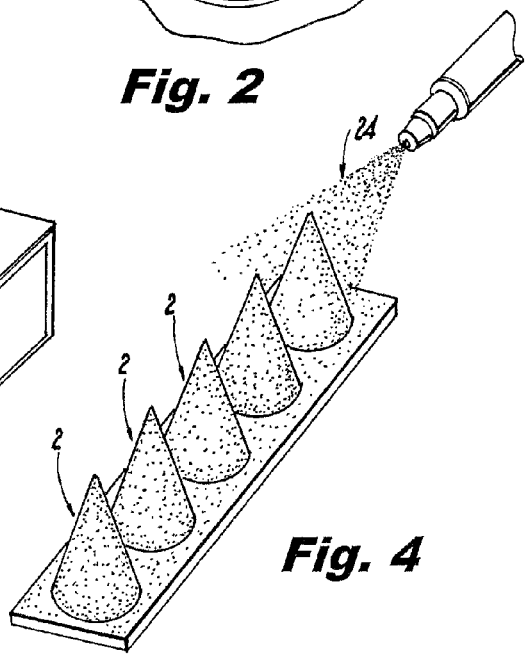
FIG. 4 is a perspective view illustrating how the lemongrass essential oil is preferably applied to the bottle cover of the present invention.
Figure 5:
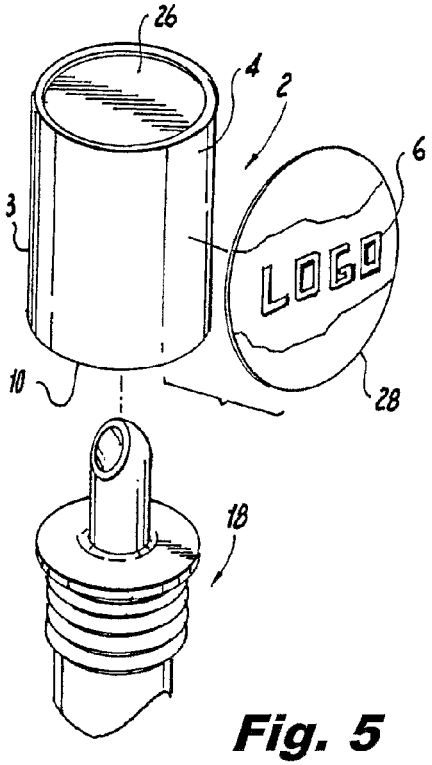
FIG. 5 is an exploded perspective view of another embodiment of the bottle cover formed in accordance with the present invention, illustrating how an advertisement or logo may be attached to the sidewall thereof.
Figure 6:
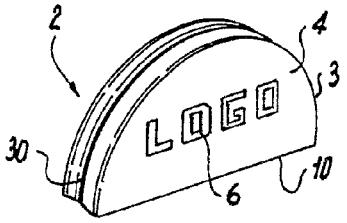
FIG. 6 is a perspective view of another form of the bottle cover of the present invention, which is collapsible and expandable and which includes a sidewall that provides sufficient space for a logo or advertisement to be placed thereon.
Figure 7:
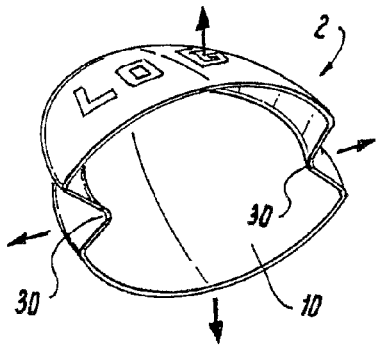
FIG. 7 is another perspective view of the bottle cover of the present invention shown in FIG. 6 in an expanded state usable to be fitted over the open end of a bottle.

In accordance with one form of the present invention, a disposable pest entry barrier and open bottle cover 2 may be formed in various shapes, such as a conical shape shown in FIGS. 1-4, a cylindrical shape such as shown in FIG. 5, a collapsible and expandable hemispherical shape shown in FIGS. 6 and 7, and a collapsible and expandable polygonal shape shown in FIGS. 8-11. Each of the various configurations of the bottle cover of the present invention includes a sidewall 4 which preferably provides sufficient space to provide thereon an advertisement or logo 6.

Figure 1:
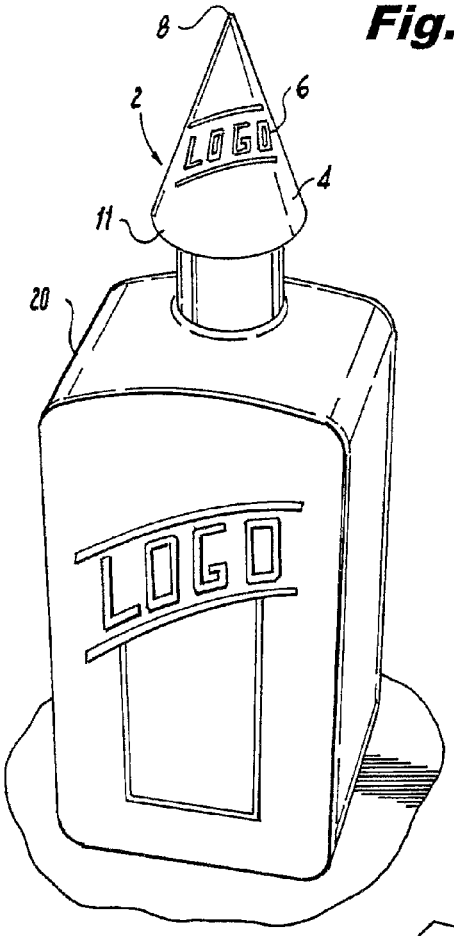
FIG. 1 is a perspective view of a disposable pest entry barrier and bottle cover constructed in accordance with the present invention, shown situated on the open end of a bottle, such as open-pour liquor and wine bottles.
Figure 2:
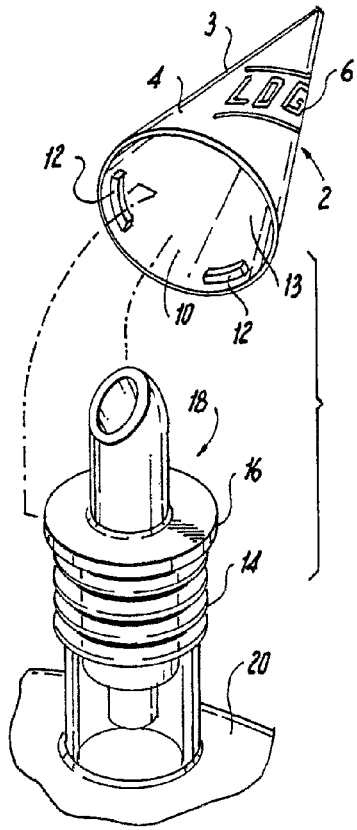
FIG. 2 is an exploded view of another form of the bottle cover of the present invention, which may be affixed to the open end of a pourer device attached to a bottle.

In FIGS. 1-4 of the drawings, it is seen that the bottle cover 2 has a conical shape, and includes a sidewall 4 which converges to an apex or point 8 at one axial end and to a widened open end 10 at the opposite axial end. A logo or advertisement 6 may be placed on the conical sidewall 4 of the bottle cover 2. As shown in FIG. 2, the open end 10 of the bottle cover 2 may include spaced apart, radially inwardly extending ribs or tabs 12, which may be fitted over the ribs 14 or end flange 16 of a pourer mechanism 18 mounted on an open-pour liquor or wine bottle 20 to help retain the bottle cover 2 of the present invention thereon until forcibly removed therefrom by the user.

Preferably, the bottle cover 2 of the present invention may be stackable with other bottle covers so that they may be easily packaged in a high density stack and transported in a package 22, as shown in FIG. 3.

Again, one of the advantages of the bottle cover 2 of the present invention is that it is preferably disposable and inexpensive to make. However, another major advantage of the bottle cover of the present invention over conventional bottle covers and caps is that it includes a repellent for fruit flies and other pests that commonly reside in bars and restaurants. As shown in FIG. 4 of the drawings, the bottle cover 2 of the present invention is preferably sprayed with a solution 24 consisting primarily of lemongrass essential oil. Such a solution may be, for example, a mixture of a percentage of water and a percentage of lemongrass oil. However, it should be realized that other mixtures and ingredients may be used and applied to the bottle cover, and other safe insect repellents, instead of lemongrass oil, may be used, and all such mixtures and ingredients are envisioned to be within the scope of the present invention. The lemongrass solution 24 acts as a natural repellent and deters fruit flies and other contaminating pests from entering the open end of the bottle 20 on which the cover 2 of the present invention is placed. This pleasant lemon-smelling additive 24 is safely used as a flavoring agent in foods and beverages in addition to being a pesticide. As mentioned previously, the bottle cover 2 of the present invention may be formed from a recyclable or non-recyclable paper or cardboard material, and the lemongrass solution 24, when sprayed onto this material, is absorbed thereby. However, the bottle cover 2 of the present invention may be formed from other material, such as plastic, whereby the lemongrass solution 24 coats the surfaces of the bottle cover 2.

FIG. 5 of the drawings illustrates another form of the bottle cover 2 of the present invention. In this case, the bottle cover 2 is formed as a cylinder having a sidewall 4 on which a logo or advertisement may be placed, a closed top cover end 26, and an axially opposite open end 10 to allow the bottle cover 2 to, be placed at its open end on the pourer 18 or open end of a bottle 20. The logo or advertisement 6 may be imprinted directly on the sidewall 4 of the bottle cover 2, but also may be printed on a film or sheet of material 28 having, for example, an adhesive backing to allow the sheet of material 28 to adhere to the sidewall 4 of the bottle cover 2.

FIGS. 6 and 7 illustrate another form of the bottle cover 2 of the present invention. Here, the bottle cover is hemispherical in shape and is expandable and collapsible (i.e., compressible). The sidewall 4 of the bottle cover 2 includes folds or pleats 30 which allow the bottle cover 2 to collapse on itself or be expanded for use to cover the open end of a bottle 20. The sidewall 4 of the expandable and collapsible bottle cover 2 also preferably provides sufficient space to allow a logo or other advertisement 6 to be placed thereon.

Figure 8:
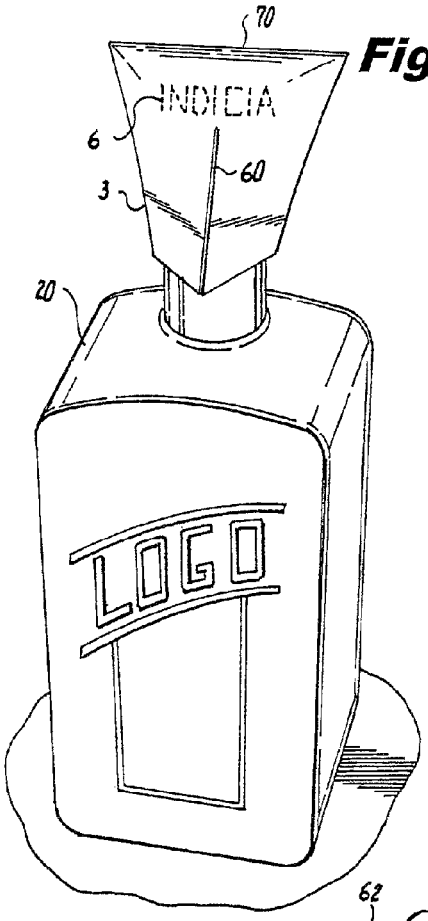
FIG. 8 is a perspective view of a disposable pest entry barrier and bottle cover constructed in accordance with another form of the present invention, shown situated on the open end of a bottle, such as open-pour liquor and wine bottles.
Figure 9:
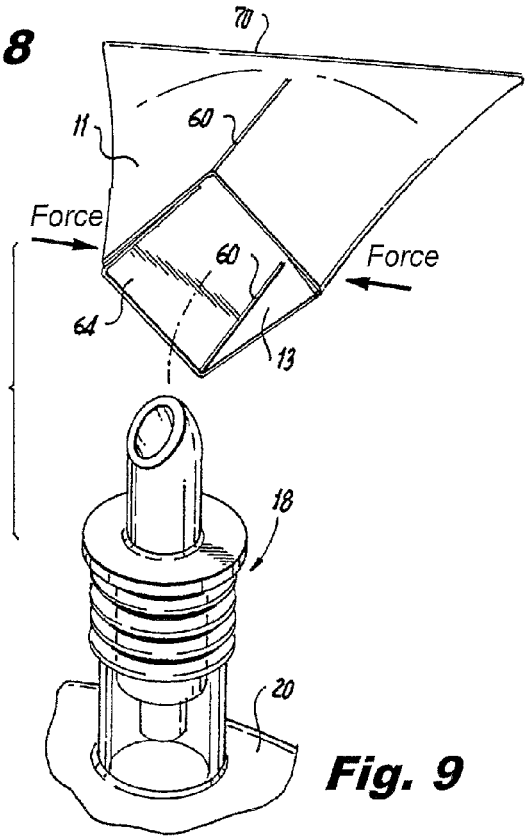
FIG. 9 is a perspective view of the bottle cover of the present invention shown in FIG. 8, and illustrating how the bottle cover may be placed on the open end of a pourer device attached to a bottle.
Figure 10:
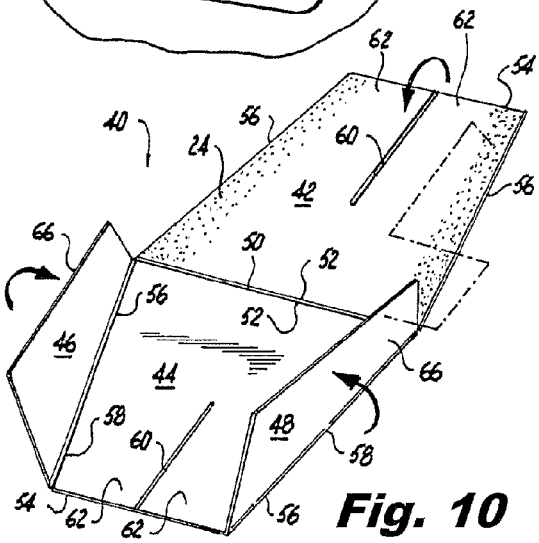
FIG. 10 is a perspective view of a cardboard or paper blank, and illustrating how the blank may be folded to form the bottle cover of the present invention shown in FIGS. 8 and 9.

FIGS. 8-11 illustrate yet another form of the disposable bottle cover 2 of the present invention. Reference should first be had to FIG. 10 of the drawings.

In FIG. 10, a cardboard or paper blank 40 is shown which may be used to form the bottle cover 2 of the present invention shown in FIGS. 8 and 9. The blank 40 is formed with two major sections 42, 44 and two side flaps 46, 48. More specifically, a first major section 42 of the blank 40 is preferably trapezoidal in overall shape and is connected at a score or crease line 50 to a second major section 44, also preferably formed with a trapezoidal shape. Thus, each of the first and second major sections 42, 44 of the blank 40 includes a first edge 52, a second edge 54 which is disposed opposite the first edge 52 and is shorter than the first edge, and two lateral opposite edges 56 which mutually converge from the first edge 52 to the shorter second edge 54. Thus, the two first edges 52 of the first and second main sections 42, 44 of the blank 40 are joined together at a crease, fold or score line 50, so that the first and second main sections 42, 44 of the blank 40 may be folded toward each other along the crease or score line 50.

As mentioned previously, the blank includes two side flaps 46, 48. One side flap 46 is attached to one of the lateral edges 56 of either the first or second main section 42, 44, and the other side flap 48 is attached to the other lateral edge 56 of the first or second main section 42, 44. The side flaps 46, 48 are attached to the first or second main sections 42, 44 of the blank 40 along a fold line, crease or score line 58 so that the side flaps 46, 48 may be folded along these lines 58 inwardly of the first or second main section 42, 44 of the blank 40 on which they are attached.

Preferably, each of the first and second main sections 42, 44 of the blank 40 also includes a fold line, crease or score line 60 formed on either the upper surface or lower surface thereof and extending from the opposite shorter edge 54 at least partially toward the opposite longer edge 52 of each of the first and second main sections 42, 44 of the blank 40. These particular score lines 60 allow portions 62 of the first and second main sections 42, 44 of the blank on opposite sides of the score line 60 to be folded at least partially towards one another, as shown in FIG. 9 of the drawings, so that, when the blank 40 is assembled to form the bottle cover 2 of the present invention, the bottle cover will exhibit a square or rectangular opening 64 for receiving either the open end of the bottle 20, as shown in FIG. 8, or a pourer 18 affixed to the open end of the bottle 20, as shown in FIG. 9 of the drawings.

The bottle cover 2 of the present invention shown in FIGS. 8 and 9 is assembled from the blank 40 shown in FIG. 10. The side flaps 46, 48 include an upper surface 66 carrying an adhesive or on which an adhesive is placed. The side flaps 46, 48 are folded inwardly on top of the first or second main section 42, 44 of the blank 40 from which they extend. Then, the other of the first or second main section 42, 44 of the blank 40 is folded downwardly over the inwardly folded side flaps 46, 48 and the other of the first or second main section 42, 44, thus forming the unexpanded bottle cover 2 shown in FIG. 11 of the drawings.

Figure 11:
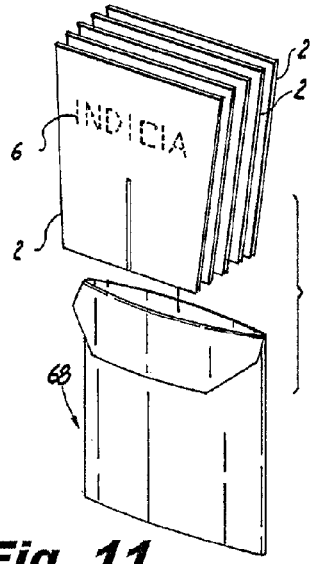
FIG. 11 is a perspective view of a plurality of the bottle covers of the present invention shown in FIGS. 8 and 9, and illustrating how the plurality of bottle covers may be compactly received in a package.

A plurality of the unused and unexpanded bottle covers 2 of the present invention may be packaged in one or more envelopes 68, as shown in FIG. 11, and individual or multiple bottle covers 2 may be conveniently withdrawn from the envelope 68 as required. By pressing inwardly on the lateral sides of the assembled bottle cover 2, the first and second main sections 42, 44 may expand outwardly from each other along the partial crease or fold line 60 to form a rectangular or square opening 64, as shown in FIG. 9. This opening 64 allows the bottle cover 2 to be placed on the open end of the bottle 20, as shown in FIG. 8, or on a pourer 18, as shown in FIG. 9, to cover the open ends of the bottle or pourer when such are not in use.

As described previously with the other embodiments of the present invention, the expandable bottle covers 2 shown in FIGS. 8-11 may be sprayed or coated preferably on one of the surfaces of the blank 40, such as on one or both of the inner and outer surfaces of either the first major section 42 or the second major section 44, or both, with a solution consisting primarily of lemongrass essential oil or another safe insect repellent 24 to deter fruit flies and other contaminating pests from entering the open end of the bottle 20 or pourer 18 on which the cover of the present invention is placed.

With respect to the embodiment shown in FIGS. 8-11, it should be understood that the first and second main sections 42, 44 of the blank 40 shown in FIG. 10 need not be trapezoidal in shape, but may be rectangular or square, or take on some other shape. The trapezoidal shape is preferred, because it allows additional room to add a logo or other indicia or slogan 6 that may be printed near the folded-over top portion 70 of the bottle cover 2, as shown in FIG. 11, and as described previously with respect to the other embodiments of the present invention. Furthermore, although the expandable bottle cover 2 shown in FIGS. 8-11 is described as being formed from a cardboard or paper material, other materials may be used for forming this bottle cover and the other bottle covers 2 described herein, such as a plastic material.

To restate some of the features of the pest entry cover 2 of the present invention, the cover 2 preferably includes a main body 3, the main body 3 having a sidewall 4, a closed end 8 joined to the sidewall 4, and an open end 10 situated axially opposite the closed end 8. The main body 3 has an outer surface 11 and an inner surface 13 disposed opposite the outer surface 11.

Furthermore, the cover 2 preferably includes a coating 24 of insect repellent disposed on at least one of the inner surface 13 and the outer surface 11 of the main body 3. Preferably, the coating 24 of insect repellent includes lemongrass oil or a solution thereof.

The main body 3 may be generally conical in shape, or it may be generally cylindrical in shape, among other shapes.

Preferably, the outer surface 11 of the main body 3 includes a portion thereof on which is receivable at least one of indicia, a logo and an advertisement 6. Alternatively, or in addition to the above, the pest entry cover 2 may further include a label 28, the label 28 being mountable on a portion of the outer surface 11 of the main body 3. The label 28 includes at least one of indicia, a logo and an advertisement 6.

In another form of the present invention, the sidewall 4 of the main body 3 of the pest entry cover is at least one of expandable and compressible. At least a portion of the sidewall 4 of the main body 3 may include at least one pleat, or a fold line or a crease 30, or a plurality of pleats, fold lines or creases 30, to allow the sidewall 4 to be expandable or compressible.

In another embodiment, the main body 3 of the pest entry cover 2 further includes at least one rib 12 extending outwardly from the inner surface 13 thereof to help secure the pest entry cover 2 to the open end of a bottle 20 or a pourer device 18 attached to the open end of the bottle 20.

In yet another preferred embodiment, the main body 3 of the pest entry cover 2 is formed from a blank 40 of foldable material. The blank 40 has a first major section 42, a second major section 44, a first side flap 46 and a second side flap 48. Each of the first and second major sections 42, 44 includes a first edge 52, a second edge 54 disposed opposite the first edge 52, a third lateral edge 56 and a fourth lateral edge 56 disposed opposite the third lateral edge 56, the third and fourth lateral edges 56, 56 being disposed between the first and second edges 52, 54. The first edges 52 of the first and second major sections 42, 44 are joined together at a first fold line 50 such that the first and second major sections 42, 44 of the blank 40 are foldable relative to each other along the first fold line 50. The first side flap 46 is joined to the third lateral edge 56 of one of the first major section 42 and the second major section 44 at a second fold line 58 such that the first side flap 46 and the one of the first major section 42 and the second major section 44 are foldable relative to each other along the second fold line 58. The second side flap 48 is joined to the fourth lateral edge 56 of one of the first major section 42 and the second major section 44 at a third fold line 58 such that the second side flap 48 and the one of the first major section 42 and the second major section 44 are foldable relative to each other along the third fold line 58.

The first major section 42 and the second major section 44 are folded relative to each other along the first fold line 50. The first side flap 46 and the one of the first major section 42 and the second major section 44 are folded relative to each other along the second fold line 58. The second side flap 48 and one of the first major section 42 and the second major section 44 are folded relative to each other along the third fold line 58.

Preferably, each of the first major section 42 and the second major section 44 has formed therein a fold line 60 which extends at least partially along the longitudinal length thereof in a direction between the first edge 52 and the second edge 54 thereof. Each of the first major section 42 and the second major section 44 are at least partially foldable along the respective fold line 60 formed therein so that the main body 3 is expandable by the first major section 42 being partially spaced apart from the second major section 44 and thereby defining the open end 10 of the main body 3.

Even more preferably, the fold line 60 formed on the first major section 42 and the second major section 44 extends centrally and in a longitudinal direction between the first edge 52 and the second edge 54 respectively of each of the first major section 42 and the second major section 44. Preferably, each of the first major section 42 and the second major section 44 of the blank 40 is generally trapezoidal in shape.

The bottle covers 2 of the present invention are designed to address local health department and, possibly, FDA, concerns regarding sanitary conditions at local eating and drinking establishments, while also offering the additional benefit of enabling companies to further their brand through unique advertising. The bottle covers 2 serve at least two basic purposes: 1) protection against pests, such as fruit flies, that commonly reside in bars and restaurants; and 2) offering corporations an opportunity to promote their brand through distinctive advertising placed on the bottle cover 2.

The bottle covers 2 of the present invention are inexpensive to make and are disposable, and are preferably made of recyclable paper or cardboard. The solution 24 of lemongrass essential oil sprayed or otherwise deposited on the bottle cover 2 of the present invention safely deters fruit flies and other contaminating pests from landing or crawling on the bottle cover and entering the open end of the bottle 20 on which the cover 2 is placed.

The various forms of the bottle covers 2 of the present invention are engineered to fit most if not all bottles 20 and are designed to provide the proper display/frontage area for optimum advertising opportunities. Once placed on the top of the pourer 18 or open bottles 20, the bottle cover 2 of the present invention can feature distinctive advertising, logos and messages 6, which help to enhance sales of the advertised products. It is envisioned that the bottle covers 2 of the present invention will be marketed to major corporations in the food and beverage, hospitality and sports industries. Furthermore, slogans such as "Drink Responsibly" may be printed on the bottle covers 2 of the present invention to satisfy public safety concerns and to remind patrons of their responsibility to limit their consumption of alcoholic beverages. Logos and advertisements may be placed on the bottle cover 2 of the present invention by restaurants, for example, advertising their names and trademarks, or by hotels. Additionally, major liquor and energy drink companies may wish to advertise their products with advertisements and logos 6 on the bottle cover 2 of the present invention.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

What is claimed is:

1. A pest entry cover for placement over the open end of a bottle, which comprises:

a main body, the main body having a sidewall, a closed end joined to the sidewall, and an open end situated axially opposite the closed end, the main body having an outer surface and an inner surface disposed opposite the outer surface; and a coating of insect repellent disposed on at least one of the inner surface and the outer surface of the main body;

wherein the main body is formed from a blank of foldable material, the blank having a first major section, a second major section, a first side flap and a second side flap, each of the first and second major sections including a first edge, a second edge disposed opposite the first edge, a third lateral edge and a fourth lateral edge disposed opposite the third lateral edge, the third and fourth lateral edges being disposed between the first and second edges, the first edges of the first and second major sections being joined together at a first fold line such that the first and second major sections of the blank are foldable relative to each other along the first fold line, the first side flap being joined to the third lateral edge of one of the first major section and the second major section at a second fold line such that the first side flap and the one of the first major section and the second major section are foldable relative to each other along the second fold line, the second side flap being joined to the fourth lateral edge of one of the first major section and the second major section at a third fold line such that the second side flap and the one of the first major section and the second major section are foldable relative to each other along the third fold line;

wherein the first major section and the second major section are folded relative to each other along the first fold line;

wherein the first side flap and the one of the first major section and the second major section are folded relative to each other along the second fold line;

wherein the second side flap and one of the first major section and the second major section are folded relative to each other along the third fold line; and wherein each of the first major section and the second major section has formed therein a fold line which extends at least partially along the longitudinal length thereof in a direction between the first edge and the second edge thereof, each of the first major section and the second major section being at least partially foldable along the respective fold line formed therein so that the main body is expandable by the first major section being partially spaced apart from the second major section and thereby defining the open end of the main body.

2. A pest entry cover as defined by claim 1, wherein the coating of insect repellent includes lemongrass oil or a solution thereof.

3. A pest entry cover as defined by claim 1, wherein the outer surface of the main body includes a portion thereof on which is receivable at least one of indicia, a logo and an advertisement.

4. A pest entry cover as defined by claim 1, which further comprises a label, the label being mountable on a portion of the outer surface of the main body.

5. A pest entry cover as defined by claim 4, wherein the label includes at least one of indicia, a logo and an advertisement.

6. A pest entry cover as defined by claim 1, wherein the main body further includes at least one rib extending outwardly from the inner surface thereof.

7. A pest entry cover as defined by claim 1, wherein the fold line formed on the first major section and the second major section extends centrally and in a longitudinal direction between the first edge and the second edge respectively of each of the first major section and the second major section.

8. A pest entry cover as defined by claim 1, wherein each of the first major section and the second major section of the blank is generally trapezoidal in shape.

9. A pest entry cover for placement over the open end of a bottle, which comprises:

a main body, the main body having a sidewall, a closed end joined to the sidewall, and an open end situated axially opposite the closed end, the main body having an outer surface and an inner surface disposed opposite the outer surface;

wherein the main body is formed from a blank of foldable material, the blank having a first major section, a second major section, a first side flap and a second side flap, each of the first and second major sections including a first edge, a second edge disposed opposite the first edge, a third lateral edge and a fourth lateral edge disposed opposite the third lateral edge, the third and fourth lateral edges being disposed between the first and second edges, the first edges of the first and second major sections being joined together at a first fold line such that the first and second major sections of the blank are foldable relative to each other along the first fold line, the first side flap being joined to the third lateral edge of one of the first major section and the second major section at a second fold line such that the first side flap and the one of the first major section and the second major section are foldable relative to each other along the second fold line, the second side flap being joined to the fourth lateral edge of one of the first major section and the second major section at a third fold line such that the second side flap and the one of the first major section and the second major section are foldable relative to each other along the third fold line;

wherein the first major section and the second major section are folded relative to each other along the first fold line;

wherein the first side flap and the one of the first major section and the second major section are folded relative to each other along the second fold line;

wherein the second side flap and one of the first major section and the second major section are folded relative to each other along the third fold line; and wherein each of the first major section and the second major section has formed therein a fold line which extends at least partially along the longitudinal length thereof in a direction between the first edge and the second edge thereof, each of the first major section and the second major section being at least partially foldable along the respective fold line formed therein so that the main body is expandable by the first major section being partially spaced apart from the second major section and thereby defining the open end of the main body.

10. A pest entry cover as defined by claim 9, wherein the outer surface of the main body includes a portion thereof on which is receivable at least one of indicia, a logo and an advertisement.

11. A pest entry cover as defined by claim 9, which further comprises a label, the label being mountable on a portion of the outer surface of the main body.

12. A pest entry cover as defined by claim 11, wherein the label includes at least one of indicia, a logo and an advertisement.

13. A pest entry cover as defined by claim 9, wherein the fold line formed on the first major section and the second major section extends centrally and in a longitudinal direction between the first edge and the second edge respectively of each of the first major section and the second major section.

14. A pest entry cover as defined by claim 9, wherein each of the first major section and the second major section of the blank is generally trapezoidal in shape.

15. A pest entry cover as defined by claim 9, wherein the main body further includes at least one rib extending outwardly from the inner surface thereof.

* * * * *